US007942498B2

(12) United States Patent
Tsuzuki et al.

(10) Patent No.: US 7,942,498 B2
(45) Date of Patent: May 17, 2011

(54) LIQUID DISCHARGING DEVICE

(75) Inventors: Masakazu Tsuzuki, Shiojiri (JP); Hirokazu Nunokawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 695 days.

(21) Appl. No.: 12/016,797

(22) Filed: Jan. 18, 2008

(65) Prior Publication Data

US 2008/0174634 A1 Jul. 24, 2008

(30) Foreign Application Priority Data

Jan. 19, 2007 (JP) ..... 2007-010705
Nov. 6, 2007 (JP) ..... 2007-288895

(51) Int. Cl.
*B41J 2/15* (2006.01)

(52) U.S. Cl. ..... 347/43; 347/40

(58) Field of Classification Search ..... 347/8, 12, 347/15, 40, 43
See application file for complete search history.

(56) References Cited

U.S. PATENT DOCUMENTS 4,599,627 A * 7/1986 Vollert ..... 347/20
5,949,451 A * 9/1999 Takagi ..... 347/40
6,209,985 B1 * 4/2001 Minamizawa ..... 347/40

FOREIGN PATENT DOCUMENTS

JP 2006-076129 3/2006

* cited by examiner

*Primary Examiner* — Lamson D Nguyen
(74) *Attorney, Agent, or Firm* — Workman Nydegger

(57) ABSTRACT

Provided is a liquid discharging device including: a first head unit which discharges liquid; a second head unit which faces a portion of a medium, in which the liquid is discharged from the first head unit, and discharges liquid; and a support member which faces the first head unit and the second head unit and supports the medium, wherein in the first head unit and the second head unit, a plurality of nozzles are arranged in a crossing direction crossing a transporting direction of the medium over an overall dischargeable range of the liquid, and a distance between the second head unit and the support member is larger than that between the first head unit and the support member.

19 Claims, 10 Drawing Sheets

LIQUID DISCHARGING DEVICE

BACKGROUND

1. Technical Field

The present invention relates to a liquid discharging device.

2. Related Art

An ink jet printer discharges ink from a head onto a medium such as recording paper, cloth or OHP film so as to print an image. When the ink is discharged from the head onto the medium, moisture of the ink permeates a fiber layer of a portion of a medium onto which the ink is discharged and thus the fiber layer expands. Accordingly, when the ink is discharged onto the medium so as to print the image, the medium may be curved or crinkled such that a cross-sectional shape of the medium is deformed. The deformation of the cross-sectional shape of the medium occurs in a liquid discharging device for discharging liquid as well as the ink jet printer.

Accordingly, in the related art, achromic liquid is discharged onto a surface opposite to a surface onto which chromatic liquid is discharged so as to suppress the deformation of the cross-sectional shape of the medium (for example, see JP-A-2006-76129).

In a liquid discharging device including a plurality of head units, for example, when cyan ink is discharged from a head unit for discharging the cyan ink onto a medium, a portion of the medium onto which the cyan ink is discharged faces another head unit for discharging magenta ink. When a portion of a medium onto which liquid is discharged from a first head unit faces a second head unit, a cross-sectional shape of the medium is deformed by the discharge of the liquid from the first head unit. Accordingly, a front end of the medium or a curved portion of the medium may come into contact with the second head unit.

SUMMARY

An advantage of some aspects of the invention is that a front end of a medium or a curved portion of the medium is suppressed from coming into contact with a second head unit.

According to an aspect of the invention, there is provided a liquid discharging device including: a first head unit which discharges liquid; a second head unit which faces a portion of a medium, in which the liquid is discharged from the first head unit, and discharges liquid; and a support member which faces the first head unit and the second head unit and supports the medium, wherein in the first head unit and the second head unit, a plurality of nozzles are arranged in a crossing direction crossing a transporting direction of the medium over an overall dischargeable range of the liquid, and a distance between the second head unit and the support member is larger than that between the first head unit and the support member.

Other features of the invention become apparent by describing embodiments of the invention with reference to the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
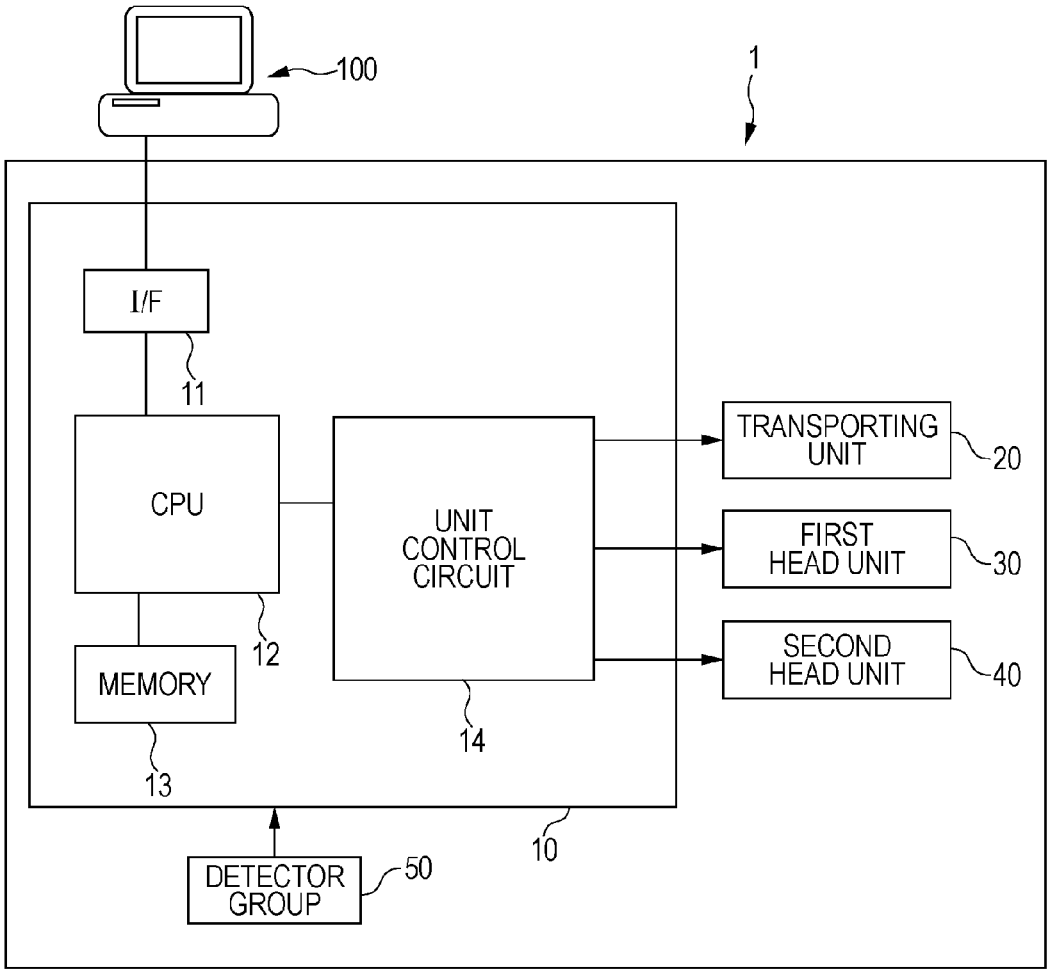
FIG. 1 is a block diagram showing the overall configuration of a printer.

The following becomes apparent by describing embodiments of the invention with reference to the accompanying drawings.

That is, it is possible to realize a liquid discharging device including: a first head unit which discharges liquid; a second head unit which faces a portion of a medium, in which the liquid is discharged from the first head unit, and discharges liquid; and a support member which faces the first head unit and the second head unit and supports the medium, wherein in the first head unit and the second head unit, a plurality of nozzles are arranged in a crossing direction crossing a transporting direction of the medium over an overall dischargeable range of the liquid, and a distance between the second head unit and the support member is larger than that between the first head unit and the support member.

According to the liquid discharging device, even when the cross-sectional shape of the medium is deformed by discharging the liquid from the first head unit, it is possible to suppress a front end of the medium or a curved portion of the medium from being brought into contact with the second head unit.

In such a liquid discharging device, it is preferable that the first head unit discharges chromatic liquid and the second head unit discharges achromic liquid. It is preferable that the first head unit discharges achromic liquid and the second head unit discharges chromatic liquid.

According to the liquid discharging device, even when the cross-sectional shape of the medium is deformed by discharging the liquid from the first head, it is possible to suppress a front end of the medium or a curved portion of the medium from being brought into contact with the second head.

In such a liquid discharging device, it is preferable that one of the first head unit and the second head unit discharges the achromic liquid in the periphery of a range in which the chromatic liquid is discharged from the other of the first head unit and the second head unit, and a dot density of the achromic liquid discharged from one of the first head unit and the second head unit is lower than that of the chromatic liquid from the other of the first head unit and the second head unit.

According to the liquid discharging device, even when the accuracy of the hitting position of the achromic liquid is decreased, it is possible to suppress the deformation of the cross-sectional shape of the medium. Accordingly, since the distance between the second head and the support member can be set to be larger than that of the first head and the support member, it is possible to suppress a front end of the medium or a curved portion of the medium from being brought into contact with the second head.

In such a liquid discharging device, it is preferable that the first head unit and the second head unit discharge chromatic liquid. It is preferable that the second head unit discharges the liquid having a color different from that of the liquid discharged from the first head unit.

According to the liquid discharging device, even when moisture is permeated into a fiber layer of a portion of the medium, in which the chromatic liquid is discharged from the first head unit, such that the cross-sectional shape of the medium is deformed, it is possible to suppress a front end of the medium or a curved portion of the medium from being brought into contact with the second head unit when the portion of the medium, in which the chromatic liquid is discharged from the first head unit, faces the second head unit.

The range of a print image formed by discharging the chromatic liquid is divided into a pixel portion in which the chromatic ink is discharged from the first head and a pixel portion in which the chromatic ink is discharged from the second head. Accordingly, since the amount of moisture permeated into the medium when the chromatic ink is discharged from the first head, it is possible to suppress the deformation of the cross-sectional shape of the medium.

In such a liquid discharging device, it is preferable that the second head unit includes a plurality of second nozzles of which positions in an orthogonal direction orthogonal to the transporting direction of the medium are aligned with the positions of a plurality of nozzles of the first head unit, the plurality of second nozzles discharging the liquid having the same color as the liquid discharged from the first head unit, and discharges the liquid in a portion of the medium, in which the liquid is not discharged from the first head unit.

According to the liquid discharging device, since the liquid having the same color is discharged from the first head unit and the second head unit and portions of the medium in which the liquid is discharged from the second head unit and the first head unit are different from each other, it is possible to realize speed-up of processing.

In such a liquid discharging device, it is preferable that the first head unit includes a first nozzle row group in which first nozzle rows having a length shorter than the dischargeable range are arranged in a zigzag manner such that the nozzles are arranged over the overall dischargeable range, and the second head unit includes a second nozzle row group in which second nozzle rows having a length shorter than the dischargeable range are arranged in the zigzag manner such that the nozzles are arranged over the overall dischargeable range.

According to the liquid discharging device, it is possible to readily manufacture the head units. Further, it is possible to readily manufacture the liquid discharging device.

In such a liquid discharging device, it is preferable that the first head unit includes a first nozzle row in which the plurality of nozzles are arranged in the crossing direction such that the nozzles are arranged over the overall dischargeable range, and the second head unit includes a second nozzle row in which the plurality of nozzles are arranged in the crossing direction such that the nozzles are arranged over the overall dischargeable range.

According to the liquid discharging device, it is possible to downsize the head units. Further, it is possible to downsize the liquid discharging device.

In such a liquid discharging device, it is preferable that a partition is mounted between the first head unit and the second head unit.

If the distance between the second head unit and the support member is larger than the distance between the first head unit and the support member, the liquid discharged from the second head unit may exceed the range in which the liquid is discharged onto the medium. Therefore, according to the liquid discharging device, since the partition is mounted between the first head and the second head, it is possible to suppress the liquid discharged from the second head from exceeding the range in which the liquid is discharged onto the medium to reach the first head.

In such a liquid discharging device, it is preferable that an adjustment mechanism which adjusts any one of the distance between the first head unit and the support member and the distance between the second head unit and the support member is included.

According to the liquid discharging device, even when the cross-sectional shape of the medium is significantly deformed by discharging the liquid from the first head unit, it is possible to suppress the medium from being brought into contact with the first head unit by adjusting the distance between the first head unit and the support member. In addition, it is possible to suppress a front end of the medium or a curved portion of the medium from being brought into contact with the second head unit by adjusting the distance between the second head unit and the support member.

In a case where the deformation of the cross-sectional shape of the medium is small, it is possible to improve the accuracy of the hitting position of the liquid discharged from the first head unit or the liquid discharged from the second head unit by decreasing the distance between the first head unit and the support member or the distance between the second head unit and the support member.

In such a liquid discharging device, it is preferable that the adjustment mechanism adjusts the distance between the second head unit and the support member.

According to the liquid discharging device, in a case where the material of the fiber configuring the medium or the thickness of the medium is changed, since the amount of moisture included in the fiber layer of the portion of the medium in which the liquid is discharged from the first head unit, it is possible to suppress a front end of the medium or a curved portion of the medium from being brought into contact with the second head unit although the deformation of the cross-sectional shape of the medium is increased.

Configuration of Line Head Printer

Figure 2:
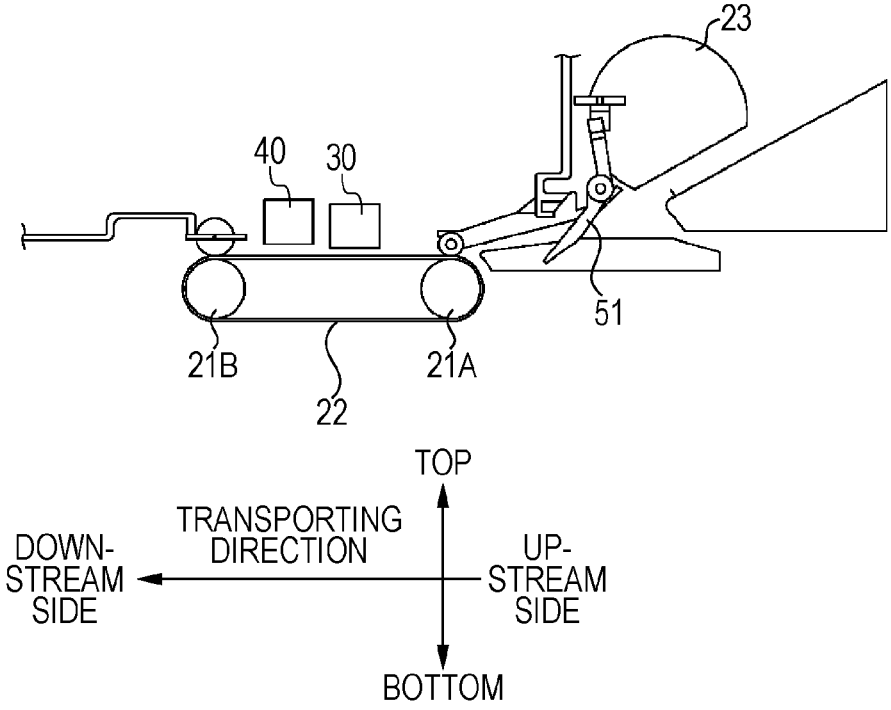
FIG. 2 is a cross-sectional view of the printer.
Figure 3:
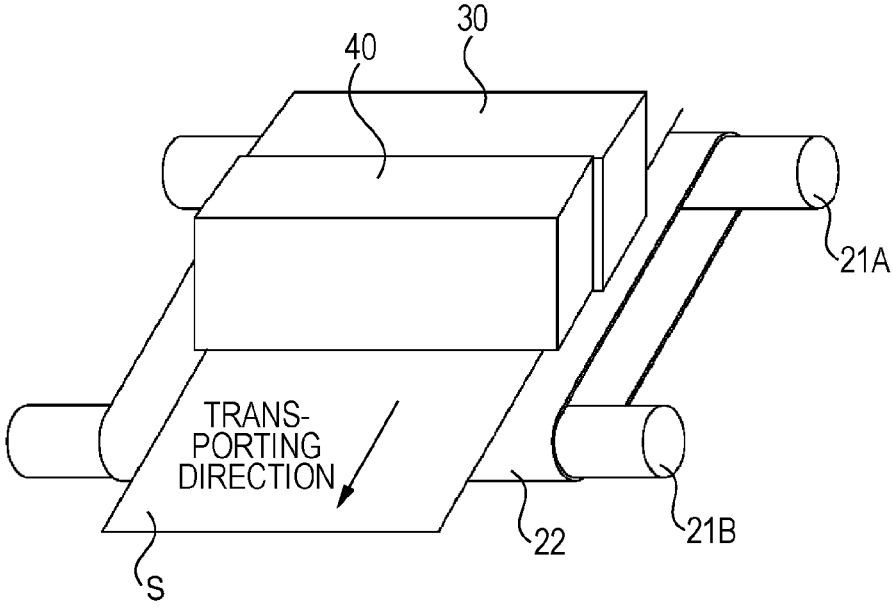
FIG. 3 is a view showing a state in which the printer transports a medium.

FIG. 1 is a block diagram showing the overall configuration of a printer 1 according to the present embodiment. FIG. 2 is a cross-sectional view of the printer 1. FIG. 3 is a view showing a state in which the printer 1 transports a medium S (also called paper S). The printer 1 is a line head printer among printers employing an ink jet method. Here, the line head printer includes a line head unit in which nozzles are arranged over an overall dischargeable range for discharging ink. The printer 1 performs four-color printing (yellow, cyan, magenta and black).

Hereinafter, the basic configuration of the printer 1 will be described. As shown in FIG. 1, the printer 1 includes a controller 10, a transporting unit 20, a first head unit 30, a second head unit 40 and a detector group 50. When print data is received from a computer 100 which is an external device, in the printer 1, the controller 10 controls the transporting unit 20, the first head unit 30 and the second head unit 40. The controller 10 controls the units 20, 30 and 40 on the basis of the print data received from the computer 100 so as to form an image on paper. The state of the printer 1 is monitored by the detector group 50. The detector group 50 outputs a detected result to the controller 10. The controller 10 which receives the detected result from the detector group 50 controls the nits 20, 30 and 40 on the basis of the detected result.

The controller 10 is a control unit for controlling the printer 1. The controller 10 includes an interface 11, a CPU 12, a memory 13, a unit control circuit 14. The interface 11 transmits/receives data between the computer 100 and the printer 1. The CPU 12 is an arithmetic processing unit for controlling the overall of the printer 1. The memory 13 ensures an area for storing a program of the CPU 12 or a working area and includes a storage device such as a RAM or an EEPROM. The CPU 12 controls the units 20, 30 and 40 through the unit control circuit 14 according to the program stored in the memory 13.

The transporting unit 20 transports the paper to a printable position in a predetermined direction (hereinafter, referred to as a transporting direction). As shown in FIGS. 2 and 3, the transporting unit 20 includes two transporting roller 21A and 21B, a belt 22, a feeding roller 23, a transporting motor (not shown). The feeding roller 23 is a roller for automatically feeding the paper inserted into a paper insertion slot. The paper fed by the feeding roller 23 is transported by a belt conveyor method. Here, the belt conveyor method is a method for transporting a transported material by an endless belt. In this example, the annular belt 22 is rotated by the transporting rollers 21A and 21B to transport the paper on the belt 22. The transporting rollers 21A and 21B are driven by the transporting motor. In addition, the paper is electrostatically adsorbed or vacuum adsorbed by the belt 22 (not shown).

The first head unit 30 discharges chromatic liquid (ink) onto the paper S. The first head unit 30 is composed of a plurality (four in the present embodiment) of first heads. That is, the plurality of first heads are arranged on a lower surface of the first head unit 30. A plurality of nozzles for discharging the chromatic ink are provided in each of the first heads. The chromatic inks are discharged from the nozzles onto the paper S which is being transported so as to form dots on the paper S, thereby printing an image on the paper S.

The printer according to the present embodiment is a line head printer and the first head unit 30 can form dots with predetermined resolution in a region of a paper width at a time. The arrangement of the four first heads configuring the first head unit 30 and the arrangement of the plurality of nozzles provided in each of the first heads will be described later.

The second head unit 40 discharges achromic liquid (ink) onto the paper S. A plurality of second heads configuring the second head unit 40 have the same configuration as the first heads configuring the first head unit. The number of second heads and the arrangement of the plurality of second heads on the lower surface of the second head unit 40 are also equal to those of the first heads configuring the first head unit 30. Accordingly, the arrangement of the plurality of nozzles provided in each of the second heads is equal to that of the plurality of nozzles provided in each of the first heads configuring the first head unit 30.

The second head unit 40 can form dots in a region of a paper width at a time with predetermined resolution. That is, the second head unit 40 discharges the achromic ink from the nozzle onto the paper S which is being transported so as to form achromic dots on the paper S with predetermined resolution. The arrangement of the four second heads configuring the second head unit 40 and the arrangement of the plurality of nozzles provided in each of the second heads will be described later.

The detector group 50 includes a rotary encoder (not shown) or a paper detection sensor 51. The rotary encoder detects the rotation amounts of the transporting rollers 21A and 21B. The paper detection sensor 51 detects the position of a front end of the paper to be printed.

Configuration of Head Unit 30

Figure 4:
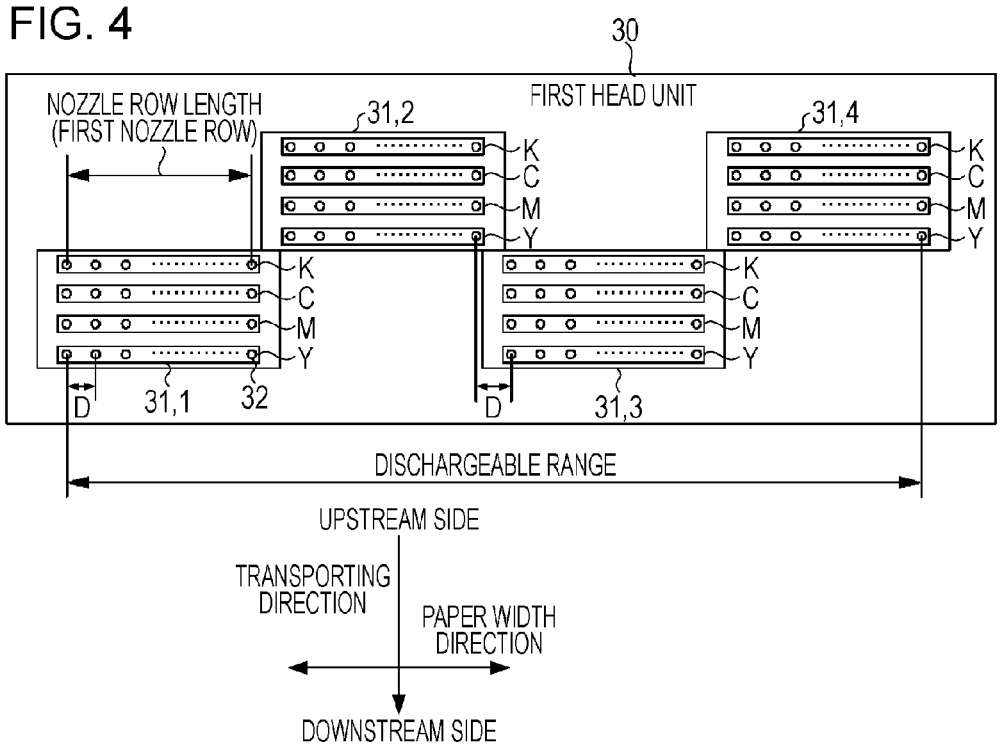
FIG. 4 is a view showing arrangement of heads and nozzles configuring a first head unit.

FIG. 4 is a view showing the arrangement of the heads and the nozzles configuring the first head unit 30. In the first head unit 30, the four first heads represented by reference numerals 31(1), 31(2), 31(3) and 31(4) are arranged in a zigzag manner in a paper width direction. The paper width direction is an orthogonal direction (vertical direction) orthogonal to the transporting direction of the paper S and is a direction along the surface of the paper S.

On the lower surface of each of the first heads 31, a yellow ink nozzle row Y, a magenta ink nozzle row M, a cyan ink nozzle row C, and a black ink nozzle row K. In the example of FIG. 4, each nozzle row includes 180 nozzles 32 as a first nozzle.

The nozzles 32 belonging to each nozzle row are aligned at a constant distance D (also called a nozzle pitch D) in the paper width direction. Accordingly, minimum resolution (dot pitch) in the paper width direction is the nozzle pitch D. In the example of FIG. 4, the nozzle pitch D is 1/180 inches.

The positions of the first heads 31(1) to 31(4) in the paper width direction are determined on the basis of the nozzles 32. In the example of FIG. 4, in two first heads 31 which are adjacent in the paper width direction, the first heads 31 are arranged such that rightmost nozzles 32 of the nozzle rows provided in the first head 31 located at the left side of the drawing and leftmost nozzles 32 of the nozzle rows provided in the first head 31 located at the right side of the drawing have the distance D. Accordingly, a maximum width (corresponds to the dischargeable range for discharging the ink) of the chromatic inks discharged onto the paper S in the paper width direction becomes the total length of the plurality of nozzle rows which are arranged in the paper width direction.

Here, the length of the nozzle rows (corresponds to first nozzle rows) of the first heads 31(1) to 31(4) is shorter than the dischargeable range. Accordingly, in the first head unit 30, the first heads 31(1) to 31(4), of which directions are determined such that the first nozzle rows are arranged in the paper width direction, are mounted in a zigzag manner such that the nozzles 32 are arranged at an equal distance over the overall discharge range. Accordingly, the first head unit 30 includes a first nozzle group composed of the plurality of first nozzle rows arranged in the zigzag manner.

Figure 5:
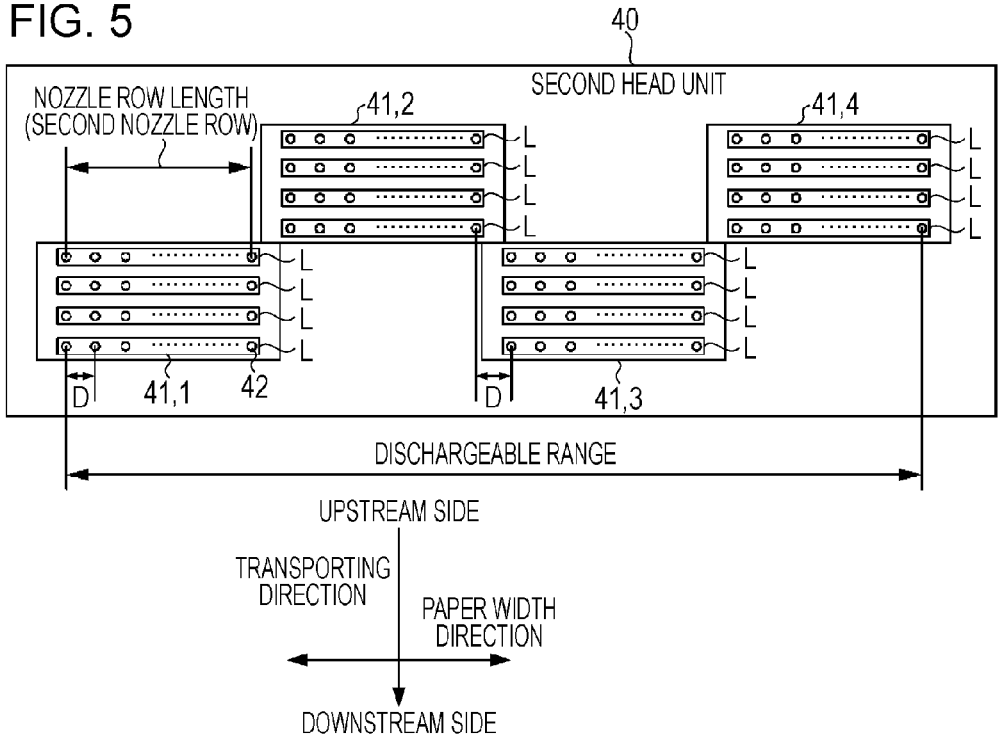
FIG. 5 is a view showing arrangement of heads and nozzles configuring a second head unit.

FIG. 5 is a view showing the arrangement of the heads and the nozzles configuring the second head unit 40. In the second head unit 40, the four second heads represented by reference numerals 41(1), 42(2), 43(3) and 44(4) are arranged in a zigzag manner in the paper width direction.

On the lower surface of each of the second heads 41, a plurality of nozzle rows L (corresponds to second nozzle rows) for discharging the achromic ink are formed. In the example of FIG. 5, each nozzle row includes 180 nozzles 42 as a second nozzle. The nozzle pitch D is 1/180 inches. Accordingly, minimum resolution of the discharged achromic ink in the paper width direction is the nozzle pitch D.

Even in the second head unit 40, the positions of the second heads 41(1) to 41(4) in the paper width direction are determined on the basis of the nozzles 42. In the example of FIG. 5, in two second heads 41 which are adjacent in the paper width direction, the second heads 41 are arranged such that rightmost nozzles 42 of the nozzle rows provided in the second head 41 located at the left side of the drawing and leftmost nozzles 42 of the nozzle rows provided in the second head 41 located at the right side of the drawing have the distance D. Accordingly, a maximum width of the achromic ink discharged onto the paper S in the paper width direction becomes the total length of the plurality of nozzle rows which are arranged in the paper width direction. The second head unit 40 includes a second nozzle group in which the second nozzle rows of the direction along the paper width direction shorter than the discharge range are arranged in a zigzag manner such that the nozzles 42 are arranged at an equal distance over the overall dischargeable range.

Now, the achromic ink discharged from the second head unit 40 will be described. The achromic ink is obtained by eliminating a color material from the chromatic ink. The viscosity of the achromic ink is equal to that of the chromatic ink. Accordingly, the achromic ink can be discharged using the head for discharging the chromatic ink. In addition, the achromic ink may be made of only water or a mixture of water and a surface active surfactant, an organic solvent, a color material or a variety of other additives. If the achromic ink has a component similar to that of the chromatic ink such that the physical property of liquid is similar to that of the chromatic ink, it is possible to set a discharge control condition of the achromic ink to be equal to that of the chromatic ink.

As shown in FIG. 3, the first heads 31(1) to 31(4) configuring the first head unit 30 and the second heads 41(1) to 41(4) configuring the second head unit 40 are provided at positions facing the belt 22 as a support member for supporting the medium S (paper). The second head unit 40 is mounted at the downstream side of the first head unit 30 in the transporting direction of the paper S. The distances between the first heads 31(1) to 31(4) configuring the first head unit 30 and the belt 22 are equal. The second heads 41(1) to 41(4) configuring the second head unit 40 and the belt 22 are equal.

The second heads 41(1) to 41(4) are provided at the downstream side of the first heads 31(1) to 31(4) in the transporting direction. Accordingly, when the ink (liquid) is discharged from the first head 31(1) while the paper S (medium) is transported by the belt 22, then a portion of the paper S on which the ink is discharged from the first head 31(1) is moved to a position facing the second head 41(1).

COMPARATIVE EXAMPLE

Figure 6:
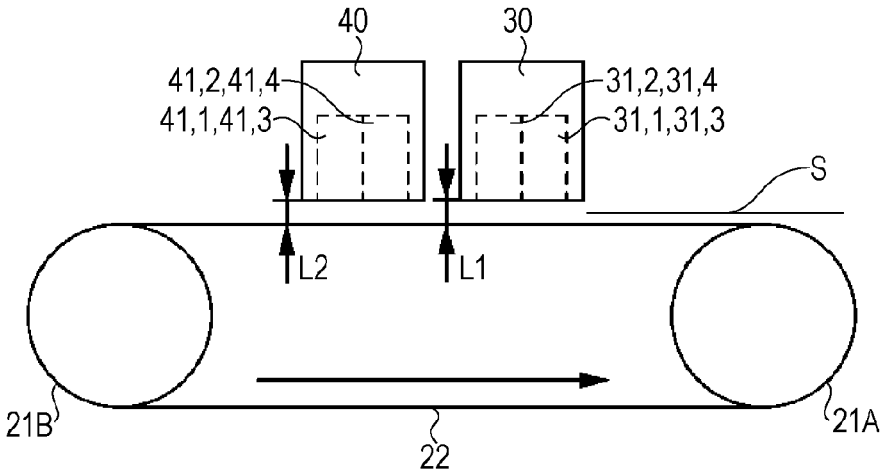
FIG. 6 is a view showing a comparative example.
Figure 7:
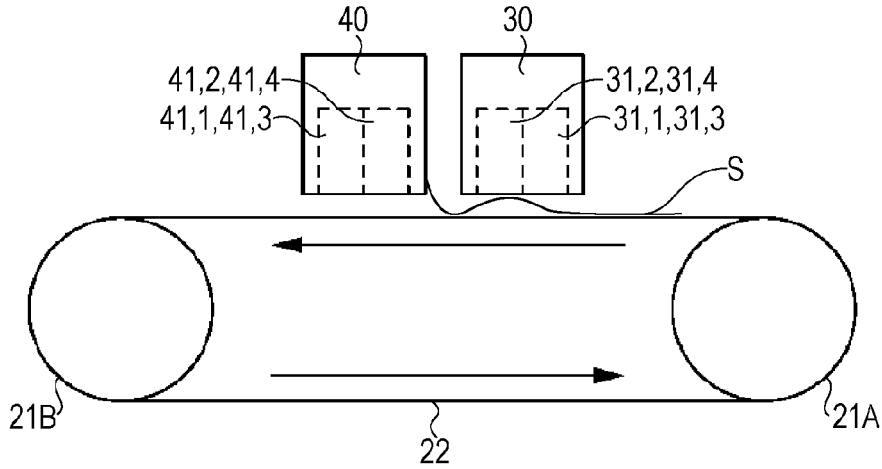
FIG. 7 is a view showing a state in which paper S is transported from the right side of the drawing to the left side.
Figure 8:
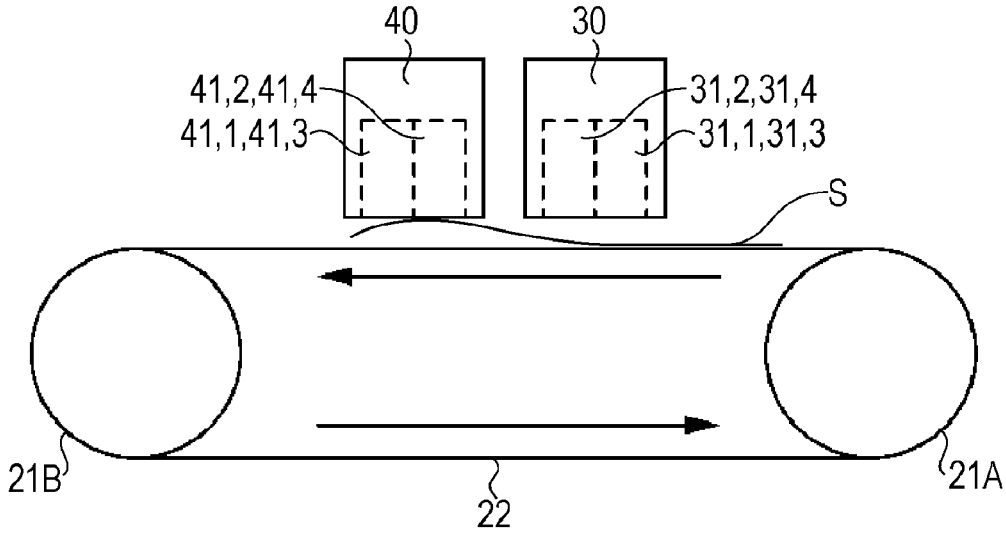
FIG. 8 is a view showing a state in which a sheet of paper S is transported from the right side of the drawing to the left side.

Now, a comparative example of a first embodiment will be described. FIG. 6 is a view showing a comparative example. In FIG. 6, the distance L2 between the second head 41(1) and the belt 22 is equal to the distance L1 between the first head 31(1) and the belt 22. FIGS. 7 and 8 show a state in which the paper S is transported from the right side to the left side of the drawing.

When the paper S is transported from the right side to the left side of the drawing and the chromatic ink is discharged from the first head 31(1), the paper S is curved such that the cross-sectional shape of the paper S is deformed. Accordingly, as shown in FIG. 7, the front end of the paper S may be brought into contact with the side surface of the second head unit 40 and, as shown in FIG. 8, a curved portion of the paper S may be brought into contact with the second head unit 40.

First Embodiment

Now, a first embodiment will be described. In the first embodiment, the ink is discharged in a state in which the distance L2 between the second head 41(1) and the belt 22 is set to be larger than the distance L1 between the first head 31(1) and the belt 22. As described above, in the first head 31(1) and the other first heads 31(2) to 31(4), the heights of the lower surfaces (corresponds to nozzle surfaces) thereof are equal. Similarly, even in the second head 41(1) and the other second heads 41(2) to 41(4), the heights of the lower surfaces (corresponds to nozzle surfaces) thereof are equal. Accordingly, in the first embodiment, the first head unit 30 and the second head unit 40 are mounted such that the distance L2 between the lower surfaces (the nozzle surfaces) of the second head unit 40 and the belt 22 are larger than the distance L1 between the lower surfaces (the nozzle surfaces) of the first head unit 30 and the belt 22. For convenience of description, the following description is made with respect to the first head 31(1) and the second head 41(1), but is applicable to the other first heads 31(2) to 31(4) and the other second heads 41(2) to 41(4).

Figure 9:
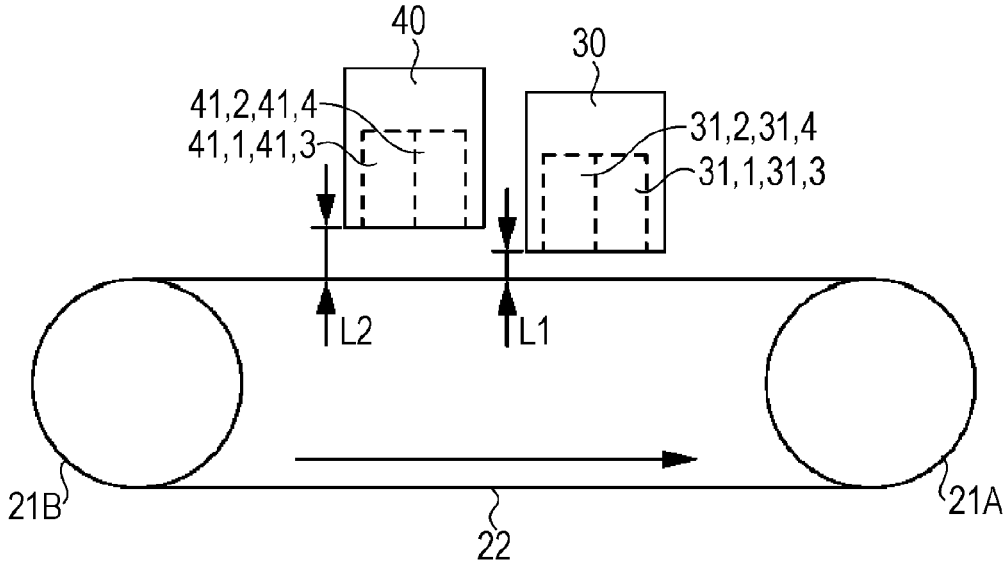
FIG. 9 is a view showing a distance between a head and a belt.

FIG. 9 is a view showing the distance between the head and the belt 22 according to the first embodiment. In FIG. 9, the distance L2 between the second head 41(1) and the belt 22 is larger than the distance L1 between the first head 31(1) and the belt 22. In the first embodiment, the chromatic ink is discharged from the first head unit 30 and the achromic ink is discharged from the second head unit 40.

The CPU 12 of FIG. 1 sequentially retrieves and executes programs for performing functions from the memory 13 when receiving image data including color information of red, green and blue from the computer 100 through the interface 11. Accordingly, the CPU 12 prepares print data obtained by converting the image data including the color information of red, green and blue to color information of yellow, cyan, magenta and black.

Next, the CPU 12 analyzes the image data including the color information of red, green and blue and prepares discharge data for discharging the achromic ink in a range formed in the periphery of the print image. Here, the print data converted from the image data received from the computer 100 includes the color information of yellow, cyan, magenta and black. Accordingly, the discharge data for discharging the achromic ink in the range formed in the periphery of the print image does not include the color information and includes information indicating that the achromic liquid is discharged.

Figure 10A:
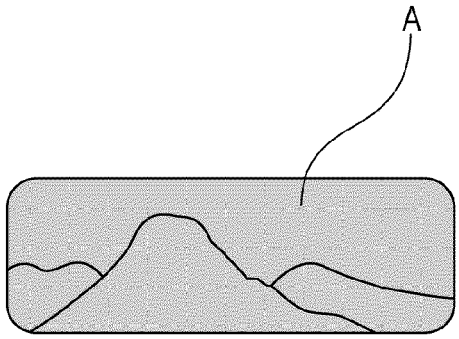
FIG. 10A is a view showing a print image printed by the printer 1.
Figure 10B:
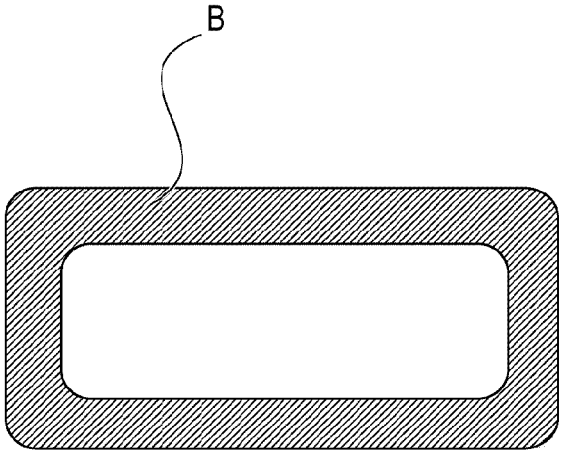
FIG. 10B is a view showing a discharge range of achromic ink discharged by the printer 1.
Figure 10C:
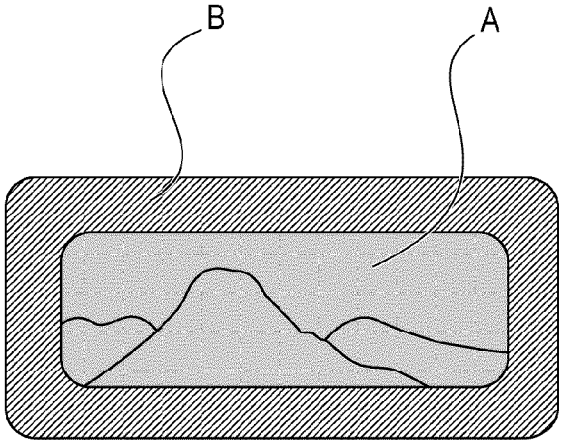
FIG. 10C is a view showing the print image printed by the printer 1 and the discharge range of the achromic ink in the periphery of the print image.

FIG. 10A is a view showing a print image printed by the printer 1. In the printed image of FIG. 10A, for example, a scenery image such as mountain is printed. FIG. 10B is a view showing a discharge range of achromic ink. FIG. 10C is a view showing the print image of FIG. 10A and the discharge range of the achromic ink discharged in the periphery of the print image. Now, a method of discharging the achromic ink in the periphery of the print image will be described using FIGS. 10A to 10C.

The CPU 12 receives image data, which is an original color image of FIG. 10A, from the computer 100. The received image data is converted into print data which can be printed by the printer 1. The CPU 12 analyzes the image data received from the computer 100 and prepares the discharge data for discharging the achromic ink in a range B of FIG. 10B in the periphery of the print image.

The CPU 12 and the unit control unit 14 analyze the selection of the nozzle for discharging the ink or a timing of discharging the ink from the prepared print data. By controlling the first heads 31(1) to 31(4) configuring the first head unit 30, the chromatic inks (the yellow ink, the magenta ink, the cyan ink and the black ink) are discharged from the corresponding nozzles. By controlling the transporting unit 20, the paper S is transported. Accordingly, the print image represented by a reference numeral A is formed on the paper S as shown in FIG. 10C.

When the chromatic inks are discharged, the CPU 12 and the unit control circuit 14 perform the control according to a gradation value. For example, the amount of discharged ink droplets is changed so as to change the size of the dot of the ink discharged onto the paper S or the number of discharged ink droplets per unit area. Accordingly, the image is printed with multiple gradations.

The CPU 12 and the unit control circuit 14 analyze the selection of the nozzle for discharging the ink or a timing of discharging the ink from the discharge data for discharging the achromic ink. By controlling the second heads 41(1) to 41(4) configuring the second head unit 40, the achromic ink is discharged from the corresponding nozzle. That is, while the paper S is transported, the achromic ink is discharged in a peripheral range of the print image A represented by a reference numeral B as shown in FIG. 10C.

In the printer 1, the chromatic inks are discharged from the first head 31(1) to 31(4) of the first head unit 30 onto the paper S so as to print the print image A. The achromic ink is discharged from the second head units 41(1) to 41(4) of the second head unit 40 in the peripheral range B of the print image A. Here, in the peripheral range B, the achromic ink is discharged such that a gradation is formed. That is, the achromic ink is discharged such that a dot density is decreased from an inner periphery to an outer periphery of the peripheral range B.

As described using FIG. 9, the distance L2 between the second head 41(1) and the belt 22 is set to be larger than the distance L1 between the first head 31(1) and the belt 22. Accordingly, in a case where the paper S is transported from the right side to the left side in FIG. 9, although the chromatic ink (liquid) is discharged from the first head unit 30 and the paper S is curved such that the cross-sectional shape of the paper S is deformed, it is possible to suppress a problem due to the deformation. For example, it is possible to suppress the front end of the paper S from being brought into contact with the side surface of the second head unit 40 or suppress the second head 41(1) from being brought into contact with the curved portion of the paper S.

If the distance L2 between the second head 41(1) and the belt 22 is larger than the distance L1 between the first head 31(1) and the belt 22, accuracy of the hitting position of the achromic ink discharged from the second head 41(1) may be decreased. However, although the accuracy of the hitting position of the achromic ink is decreased, the range in which the achromic ink is discharged is invisible as the print image and visibility is not influenced.

In the peripheral range B of the print region A, the achromic ink is discharged such that the dot density is decreased from the inner periphery to the outer periphery. Then, in the peripheral range B, the amount of moisture included in a fiber layer of the paper S is decreased toward the outer periphery. Accordingly, since a portion in which the amount of moisture included in the fiber layer of the paper S is rapidly changed does not occur, it is possible to suppress the deformation of the cross-sectional shape of the paper S due to the curvature or the crinkle of the paper S. If the achromic ink is not discharged, the chromatic ink is discharged in the fiber layer of the paper S in the vicinity of the outer periphery of the print image A such that a boundary between a region in which the chromatic ink is discharged and moisture is permeated into the fiber layer of the paper S and a region in which the chromatic ink is discharged and moisture is not permeated occurs. Then, the amount of moisture included in the fiber layer of the paper S is rapidly decreased in the vicinity of the outer periphery of the print image A. Accordingly, the paper S is easy to be bent in the vicinity of the outer periphery of the print image A.

Second Embodiment

A second embodiment will be described. In the second embodiment, the nozzle rows of the first head unit and the second head unit are different from the nozzle rows of the first embodiment. That is, the second embodiment is different from the first embodiment in that the length of one nozzle row is equal to the overall dischargeable range and the chromatic ink is discharged from the second head unit.

Figure 11:
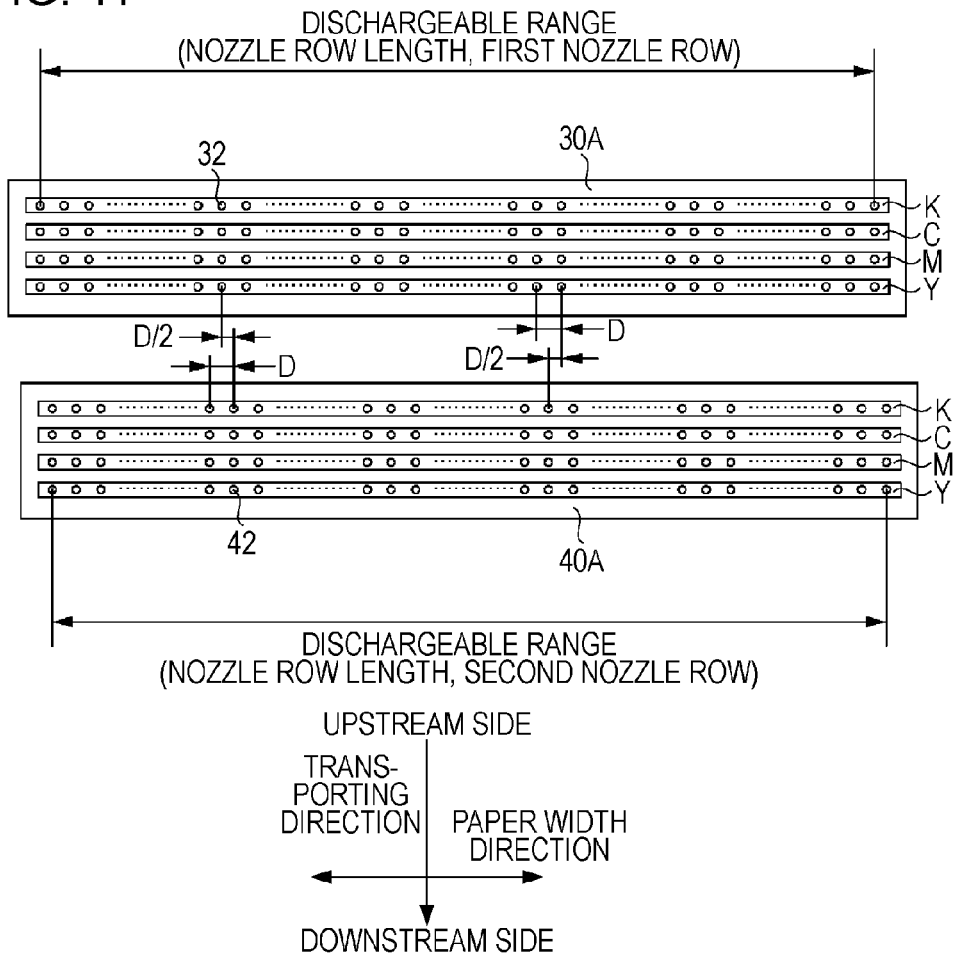
FIG. 11 is a view showing head units according to a second embodiment of the invention.

First, a first head unit 30A will be described. As shown in FIG. 11, on a lower surface of the first head unit 30A according to the second embodiment, a black ink nozzle row K, a cyan ink nozzle row C, a magenta ink nozzle row M and a yellow nozzle row Y are formed. The nozzles 32 of the nozzle rows KCMY correspond to first nozzles, similar to the first embodiment. However, each of the nozzle rows KCMY according to the second embodiment has a plurality of nozzles 32 arranged over the overall dischargeable range of the ink. That is, the length of each of the nozzle rows KCMY is equal to the dischargeable range. Here, the plurality of nozzles 32 belonging to any nozzle row are provided with a nozzle pitch D in the paper width direction. That is, the nozzles 32 are arranged at an equal distance over the dischargeable range of the ink. The number of nozzles 32 of any nozzle row is determined by the size of the dischargeable range and the nozzle pitch D. Accordingly, the first head unit 30A has a first nozzle row arranged in which the plurality of nozzles 32 are arranged in the paper width direction (crossing direction) such that the nozzles 32 (first nozzles) are arranged over the dischargeable range, for each color of the discharged ink (the type of liquid).

Next, a second head unit 40A will be described. The configuration of the second head unit 40A is equal to that of the first head unit 30A. In brief, on a lower surface of the second head unit 40A, nozzle rows KCMY for discharging four color inks are formed. A plurality of nozzles 42 of each of the nozzle rows KCMY correspond to second nozzles, similar to the first embodiment. The length of the nozzle rows KCMY is equal to the dischargeable range. The nozzles 42 are provided with the nozzle pitch D in the paper width direction. Accordingly, the second head unit 40A has a second nozzle row in which the plurality of nozzles 42 are arranged in the paper width direction such that the nozzles 42 (second nozzles) are arranged over the overall dischargeable range, for each color of the discharged ink.

Figure 12:
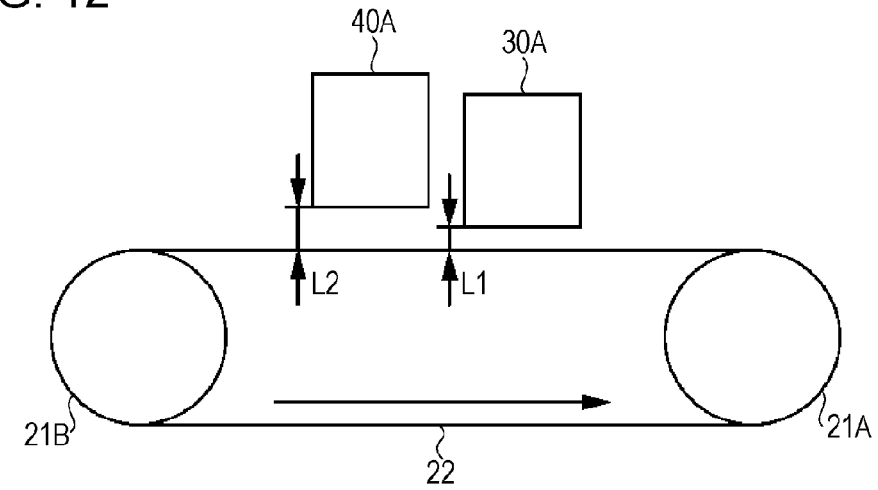
FIG. 12 is a view showing a state in which the head units according to the second embodiment are mounted.

As shown in FIG. 12, the second head unit 40A is provided at the downstream side of the first head unit 30A in the transporting direction of the paper S. The first head unit 30A is mounted such that the lower surface (nozzle surface) thereof is separated from a belt 22 by a distance L1. The second head unit 40A is mounted such that the lower surface (nozzle surface) thereof is separated from the belt 22 by a distance L2 larger than a distance L1.

Even when the paper S is deformed by the ink discharged from the first head unit 30A positioned at the upstream side of the transporting direction, it is suppress a deformed portion of the paper S from being brought into contact with the second head unit 40A.

As shown in FIG. 11, the positions of the nozzles 32 of the first head unit 30A in the paper width direction are equal in the nozzle rows KCMY. Similarly, the positions of the nozzles 42 of the second head unit 40A in the paper width direction are equal in the nozzle rows KCMY. The second head unit 40A is mounted at a position shifted from the first head unit 30A by a half (D/2) the dot pitch D in the paper width direction. Accordingly, in the paper width direction, the nozzles 42 of the second head unit 40A are arranged between the adjacent nozzles 32 of the first head unit 30A.

In the second embodiment, the first head unit 30A and the second head unit 40A discharge the same type of ink (the black ink, the cyan ink, the magenta ink and the yellow ink). Accordingly, it is possible to form dots with a pitch D/2 which is a half the nozzle pitch D. That is, it is possible to print an image with high resolution.

In the second embodiment, the image is printed by performing a printing operation twice. That is, a portion of the image is printed by the first head unit 30A and the remaining portion of the image is printed by the second head unit 40A. In this case, since a time difference occurs between a time point when the printing is performed by the upstream head unit (the first head unit 30A) and a time point when the printing is performed by the downstream head unit (the second head unit 40A), a solvent is dried. As a result, it is possible to suppress the deformation of the paper. In particular, in a case of printing an image having a high concentration (for example, a solid image), it is possible to suppress the paper from being brought into contact with the downstream head unit. Since the same type of ink is discharged from the two head units 30A and 40A and different types of inks are not discharged from the two head units 30A and 40A, it is possible to suppress color unevenness.

In the head units 30A and 40A according to the second embodiment, each of the nozzle rows KCMY has the length corresponding to the dischargeable range of the ink. Accordingly, it is possible to realize downsizing compared with the head units 30 and 40 according to the first embodiment.

In addition, in the second embodiment, the direction of each of the nozzle rows is equal to the paper width direction, this direction is not restricted. That is, the directions of the nozzle rows may be changed if the nozzles are arranged over the overall dischargeable range of the ink. In other words, the direction of each of the nozzle rows may be a crossing direction crossing the transporting direction.

Third Embodiment

A third embodiment will be described. While the same type of ink is discharged from the first head unit 30A and the second head unit 40A in the second embodiment, different types of chromatic inks are discharged from the head units in the third embodiment.

In the third embodiment, the head units 30 and 40 according to the first embodiment are used. Accordingly, as shown in FIG. 9, the distance L2 between the second head unit 40 (the second head 41(1)) and the belt 22 is set to be larger than the distance L1 between the first head unit 30 (the first head 31(1)) and the belt 22. In the first heads 31(1) to 31(4) of the first head unit 30, as shown in FIG. 4, the yellow ink nozzle row Y, the magenta ink nozzle row M, the cyan ink nozzle row C and the black ink nozzle row K are formed. In contrast, in the second head unit 40 used in the third embodiment, the arrangement of the second heads 41(1) to 41(4) and the arrangement of the nozzle rows were described with reference to FIGS. 4 and 5. However, in the third embodiment, the inks discharged from the second heads 41(1) to 41(4) are different from the inks discharged in the first embodiment. That is, the light inks are discharged from the second heads 41(1) to 41(4). The light inks are chromatic inks having concentrations of the respective color materials lower than those of the yellow ink, the magenta ink, the cyan ink and the black ink discharged from the first head unit 30. Accordingly, a light yellow nozzle row for discharging a light yellow ink, a light magenta nozzle row for discharging a light magenta ink, a light cyan nozzle row for discharging a light cyan ink and a light black nozzle row for discharging a light black ink are arranged in the second heads 41(1) to 41(4), respectively.

In the third embodiment, as described above, the yellow ink, the magenta ink, the cyan ink and the black ink are discharged from the first head unit 30 and the light yellow ink, the light magenta ink, the light cyan ink and the light black ink are discharged from the second head unit 40. Accordingly, since the inks having different concentrations can be discharged, means for changing the gradation value is increased such that the representation of the concentration of the print image is improved.

According to the printer 1 (the liquid discharging device), the range of the print image formed by discharging the chromatic inks (liquid) is divided into a pixel region in which the yellow ink, the magenta ink, the cyan ink and the black ink are discharged from the first heads 31(1) to 31(4) and a pixel portion in which the light yellow ink, the light magenta ink, the light cyan ink and the light black ink are discharged from the second heads 41(1) to 41(4). Accordingly, when the chromatic inks are discharged from the first heads 31(1) to 31(4), the amount of moisture permeated into the paper S (medium) is decreased. Accordingly, it is suppress the deformation of the cross-sectional shape of the paper S.

In the second head unit 40, since the distance L2 between the second heads 41(1) to 41(4) and the belt 22 is larger than the distance L1 between the first heads 31(1) to 31(4) and the belt 22, the accuracy of the hitting positions of the inks may be decreased. However, the concentrations of the light yellow ink, the light magenta ink, the light cyan ink and the light black ink are respectively lower than those of the yellow ink, the magenta ink, the cyan ink and the black ink and thus have a negligible influence on the quality of the print image. Accordingly, as described above, the distance L2 between the second heads 41(1) to 41(4) and the belt 22 is set to be larger than the distance L1 between the first heads 31(1) to 31(4) and the belt 22.

According to the printer 1, in the paper S, although moisture is permeated into the fiber layer of a portion in which the chromatic inks are discharged from the first heads 31(1) to 31(4) and the cross-sectional shape of this portion is deformed, it is possible to a problem due to the deformation. That is, since the second head unit 40 is separated by the distance L2, it is possible to suppress the front end of the paper S or the curved portion of the paper S from being brought into contact with the second heads 41(1) to 41(4) when the deformed portion of the paper S faces the second heads 41(1) to 41(4).

Figure 13:
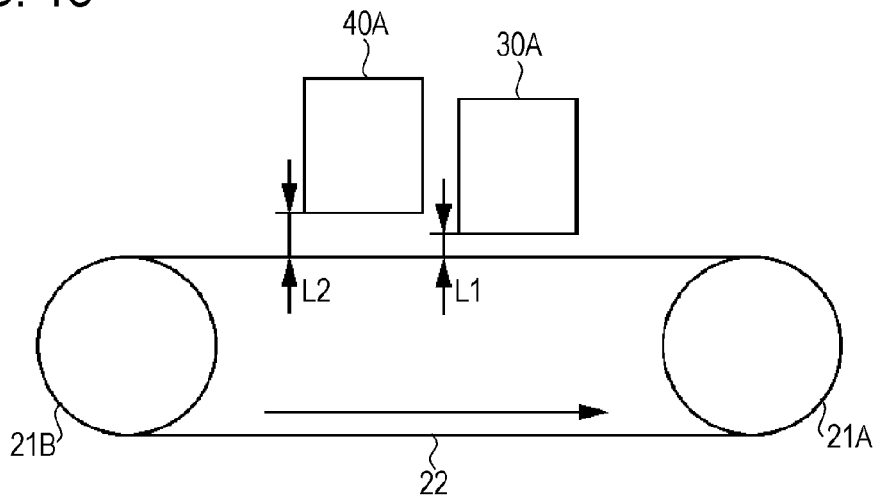
FIG. 13 is a view of a modified example of a third embodiment.

Although the head units 30 and 40 according to the first embodiment are described, the different types of chromatic inks may be discharged from the head units 30A and 40A according to the second embodiment. For example, as shown in FIG. 13, the black ink (nozzle row K), the cyan ink (nozzle row C), the magenta ink (nozzle row M) and the yellow ink (nozzle row Y) may be discharged from the nozzle rows of the first head unit 30A and a gray ink (nozzle row G), a light gray ink (nozzle row LG), a cyan ink (nozzle row LC) and a magenta ink (nozzle row LM) may be discharged from the nozzle rows of the second head unit 40A. Even in the example of FIG. 13, since the inks discharged from the second head unit 40A are the light inks, the above-described effect is obtained.

In addition, the above-described achromic ink may be discharged from a portion of the nozzle rows of the second head unit 40A.

Fourth Embodiment

Figure 14:
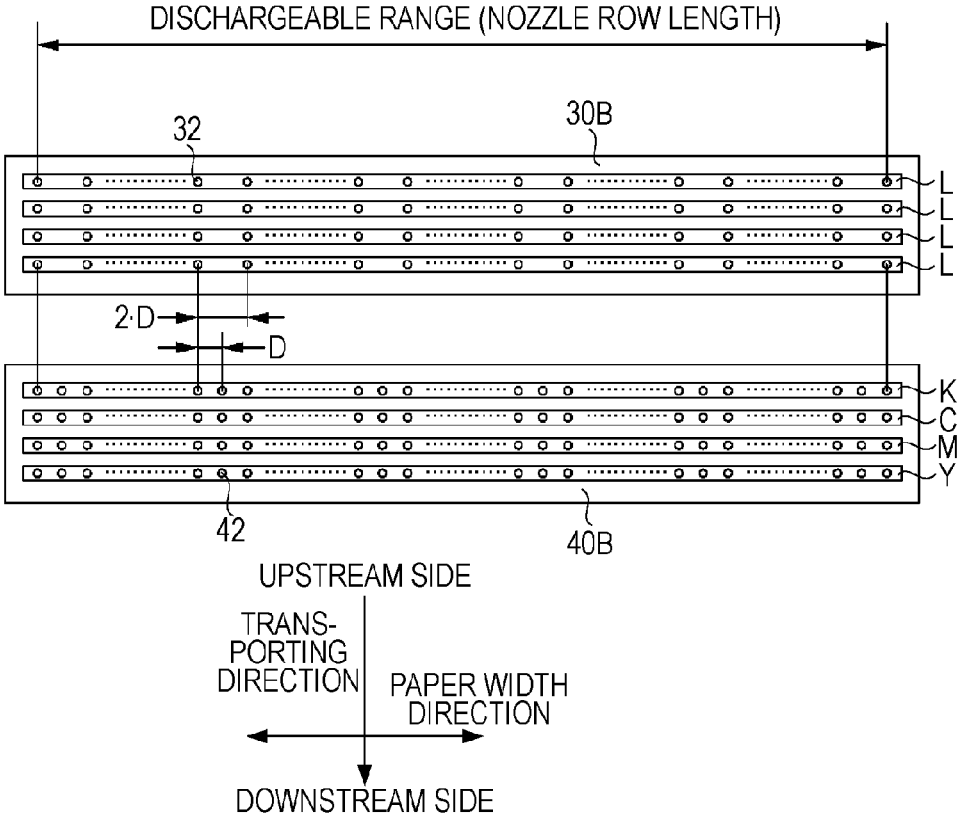
FIG. 14 is a view showing head units according to a fourth embodiment of the invention.

A fourth embodiment will be described. In the first embodiment, the chromatic ink is discharged from the first head unit 30 and the achromic ink is discharged from the second head unit 40 positioned at the downstream side of the first head unit 30 in the transporting direction. As shown in FIG. 14, in the fourth embodiment, the achromic ink is discharged from a first head unit 30B and the chromatic ink is discharged from a second head unit 40B positioned at the downstream side of the first head unit 30B in the transporting direction. Even in this configuration, since the distance L2 between the second head unit 40B and the belt 22 is set to be larger than the distance L1 between the first head unit 30B and the belt 22, the same effect as the above-described embodiments can be obtained.

The first head unit 30B includes four nozzle rows L each of which is provided in the paper width direction and has a length corresponding to the dischargeable range in the transporting direction. The nozzle pitch of the plurality of nozzles 32 belonging to the nozzle rows L is set to twice the nozzle pitch D of the plurality of nozzles 42 belonging to the second head unit 40B, due to the role of the achromic ink. As described above, the achromic ink is used to adjust the amount of moisture of the paper S (fiber layer). Accordingly, the dot density of the achromic ink may be lower than that of the chromatic ink.

From this viewpoint, in the fourth embodiment, the nozzles 32 are provided with a nozzle pitch 2·D. By this configuration, the dot density of the achromic ink discharged from the first head unit 30B is lower than that of the chromatic ink discharged from the second head unit 40B. It is advantageous that the first head unit 30B for discharging the achromic ink is more easily manufactured than the second head unit 40B.

Fifth Embodiment

Figure 15:
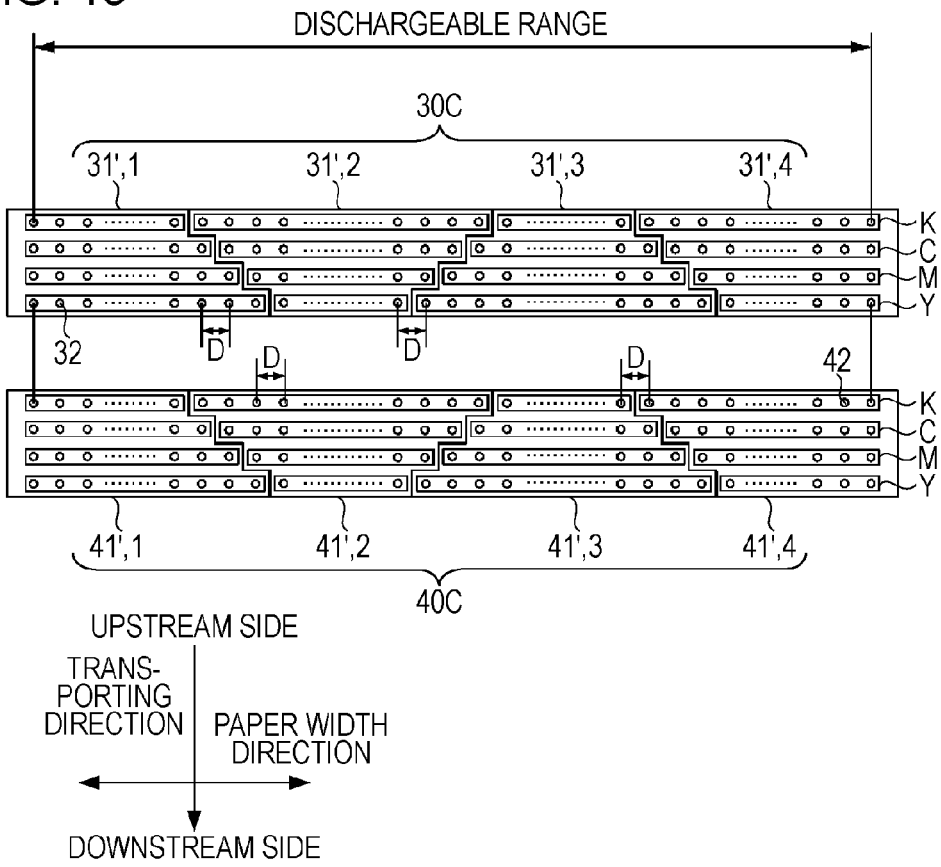
FIG. 15 is a view showing head units according to a fifth embodiment of the invention.

A fifth embodiment will be described. The head units 30 and 40 according to the first embodiment include the plurality of first heads 31(1) to 31(4) and the plurality of second heads 41(1) to 41(4) arranged in the zigzag manner in the paper width direction. As shown in FIG. 15, a first head unit 30C according to the fifth embodiment includes a plurality of first heads 31'(1) to 31'(4) which are linearly arranged in the paper width direction. In addition, a second head unit 40C includes a plurality of second heads 41'1(1) to 41'(4) which are linearly arranged in the paper width direction.

The adjacent first heads 31' are connected such that the distance between the adjacent nozzles 32 becomes the nozzle pitch D. Accordingly, a connection portion between any one first head 31' and another first head 31' is provided in a step-like pattern when viewed at the side of the nozzle surface. Similarly, the adjacent second heads 41' are connected such that the distance between the adjacent nozzles 42 becomes the nozzle pitch D. Accordingly, a connection portion between any one second head 41' and another second head 41' is provided in a step-like pattern when viewed at the side of the nozzle surface.

According to the fifth embodiment, the head units 30C and 40C can be further downsized compared with the head units 30 and 40 according to the first embodiment. Further, the printer 1 can be downsized.

In the fifth embodiment, the same ink is discharged from the head units 30C and 40C. That is, the black ink, the cyan ink, the magenta ink and the yellow ink are discharged from the first head unit 30C. The black ink, the cyan ink, the magenta ink and the yellow ink are discharged from the second head unit 40C. In addition, the plurality of nozzles of the first head unit 30C and the plurality of nozzles of the second head unit 40C are equal to each other in the position of the paper width direction. Accordingly, the head units 30C and 40C can be replaced with each other. In addition, the head units 30C and 40C can be alternately used. In this case, the controller 10 controls the first head unit 30C and the second head unit 40C so as to alternately discharge the inks. For example, the first head unit 30C discharges the inks while the second head unit 40C does not discharge the inks and the second head unit 40C discharges the inks while the first head unit 30C does not discharge the inks. By this configuration, the same type of inks can be alternately discharged from the head units 30C and the 40C. Accordingly, the inks can be discharged with a double frequency as a maximum, compared with a case of using only one head unit. That is, the speed-up of the discharging process can be realized.

Even in the fifth embodiment, since the same type of chromatic inks are discharged from the head units 30C and 40C and an image is printed by performing the printing operation twice, it is possible to suppress the deformation of the paper. In addition, it is possible to suppress color unevenness.

Sixth Embodiment

A sixth embodiment will be described. In the sixth embodiment, a partition is mounted between the first head unit 30 and the second head unit 40 according to the first embodiment and a mechanism for adjusting the distance between the second head unit 40 (the second head 41(1)) and the belt 22 is further included.

Figure 16:
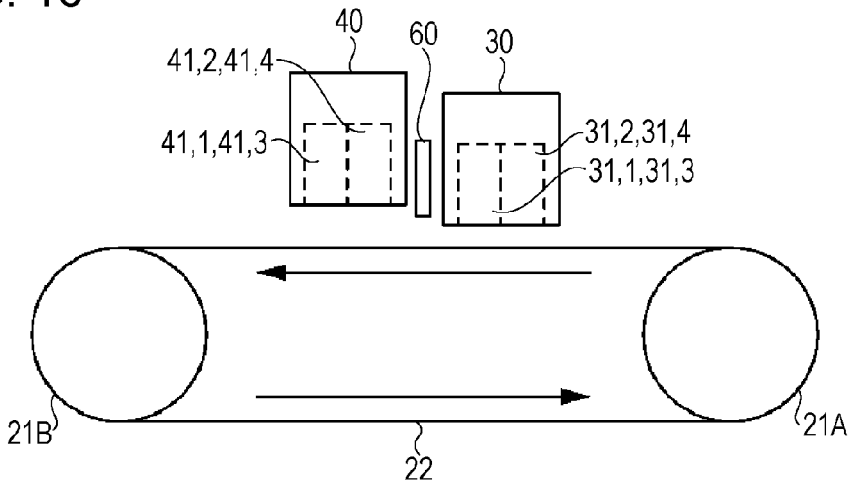
FIG. 16 is a view showing an embodiment in which a partition is mounted between a first head unit and a second head unit.

First, a case where the partition 60 is mounted between the first head unit 30 and the second unit 40. FIG. 16 is a view showing an example in which the partition 60 is mounted between the first head unit 30 and the second head unit 40.

If the distance between the second head 41(1) and the belt 22 lengthens, the accuracy of the hitting position of the ink may be decreased. In this case, when the chromatic ink is discharged from the second head unit 40 at the upstream side in the transporting direction of the paper S, the quality of the print image formed by discharging the chromatic ink from the first head unit 30 deteriorates.

The partition 60 is positioned so as to protrude from the lower surface (nozzle surface) of the second head unit 40 to the downside (liquid discharging direction). In addition, the lower end (protruding end) of the partition 60 is positioned at the upside of the lower surface (nozzle surface) of the first head unit 30. This configuration prevents a problem that the deformed portion of the paper S is brought into contact with the partition 60. The upper end of the partition 60 is positioned at the upside of the lower surface of the second head unit 40.

According to the liquid discharging device, by including the partition 60 between the first head unit 30 and the second head unit 40, it is possible to suppress the discharging of the chromatic ink from the second head unit 40 toward the first head unit 30. That is, the partition 60 covers the first head unit 30 such that the inks do not reach the first head unit 30. Accordingly, it is possible to suppress the deterioration in quality of the print image formed by discharging the chromatic ink from the first head unit 30.

Figure 17:
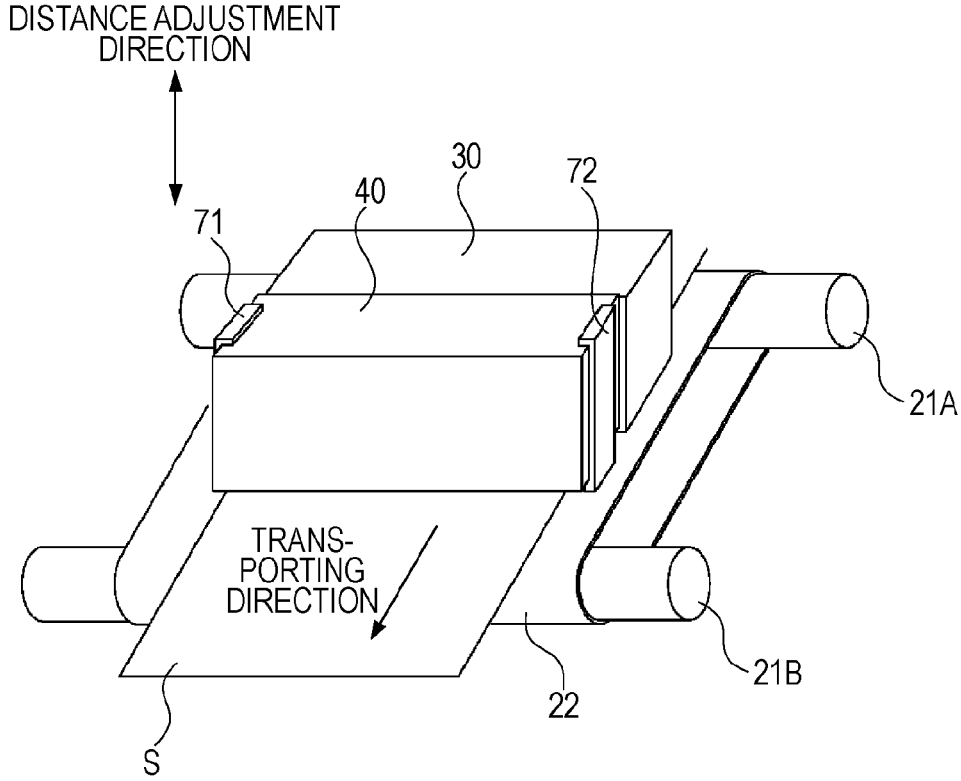
FIG. 17 is a view showing a mechanism for adjusting the distance between the second head unit and a belt.

Next, a case of using the mechanism for adjusting the distance between the second head unit 40 (the second heads 41(1) to 41(4)) and the belt 22 will be described. FIG. 17 is a view showing an example of using the mechanism for adjusting the second head unit 40 and the belt 22. As shown in FIG. 17, slide portions 71 and 72 are provided on the side surfaces of the second head unit 40 in the paper width direction. In addition, the distance between the slide portions 71 and 72 and the belt 22 is fixed by a clamp (not shown).

Grooves are formed in the side surfaces of the second head unit 40 in the paper width direction. The second head unit 40 can be moved along the fixed slide portions 71 and 72 in a distance adjustment direction shown in the drawing. The second head unit 40 is moved by the driving of the motor (not shown) and a cam mechanism (not shown). The second head unit 40 may be moved using an electromagnet. By this configuration, the distance between the second head unit 40 (the second heads 41(1) to 41(4)) and the belt 22 is adjusted.

If the amount of moisture included in the fiber layer of a portion of the paper S when the liquid is discharged from the second head unit 40 is increased by the change of the material of the fiber configuring the paper S or the thickness of the paper S, the cross-sectional shape of the paper S is susceptible to be significantly deformed. In this case, if the distance between the second head unit 40 and the belt 22 is increased, it is possible to suppress the paper S from being brought into contact with the second head unit 40.

If the amount of moisture included in the fiber layer of a portion of the paper S when the liquid is discharged from the second head unit 40 is decreased by the change of the material of the fiber configuring the paper S or the thickness of the paper S, the deformation of the cross-sectional shape of the paper S may be reduced. In this case, if the distance between the second head unit 40 and the belt 22 is decreased, the accuracy of the hitting position of the ink is improved and thus the quality of the printed image is improved.

Although the case of adjusting the distance between the second head unit 40 and the belt 22 is described, as described in the second embodiment, a mechanism for adjusting the distance between the first head unit 30 (the first heads 31(1) to 31(4)) and the belt 22 may be included. By this configuration, if the cross-sectional shape of the paper S is significantly deformed when the chromatic ink is discharged from the first head unit 30, it is possible to suppress the deformed portion of the paper S from being brought into contact with the first head unit 30, by increasing the distance between the first head unit 30 and the belt 22. In a case where the paper S is thin, it is possible to improve the accuracy of the hitting position of the ink and improve the quality of the printed image, by decreasing the distance between the first head 31(1) and the belt 22.

The above-described embodiments facilitate the understanding of the invention and are not intended to limit the invention. The invention may be changed or modified without departing from the spirit or scope of the invention and includes the equivalents thereof. Particularly, the following embodiments are included in the invention.

Configuration of Line Head Printer

Although, in the above-described embodiments, the basic configuration of the line head printer is described, the configuration may be changed. For example, the number of heads of the head unit may not be four. Although the paper S is transported by the belt conveyor method using the belt 22, the paper S may be transported by winding the paper S on a platen.

MODIFIED EXAMPLE

Although, in the above-described embodiments, the line head printer is described, a serial printer may be applied to the invention. Here, the serial printer indicates a printer for forming a print image on the paper S by repeating the transportation of the paper S and the movement of a head for discharging liquid. Hereinafter, the modified example of the invention will be described on the basis of the serial printer.

Figure 18:
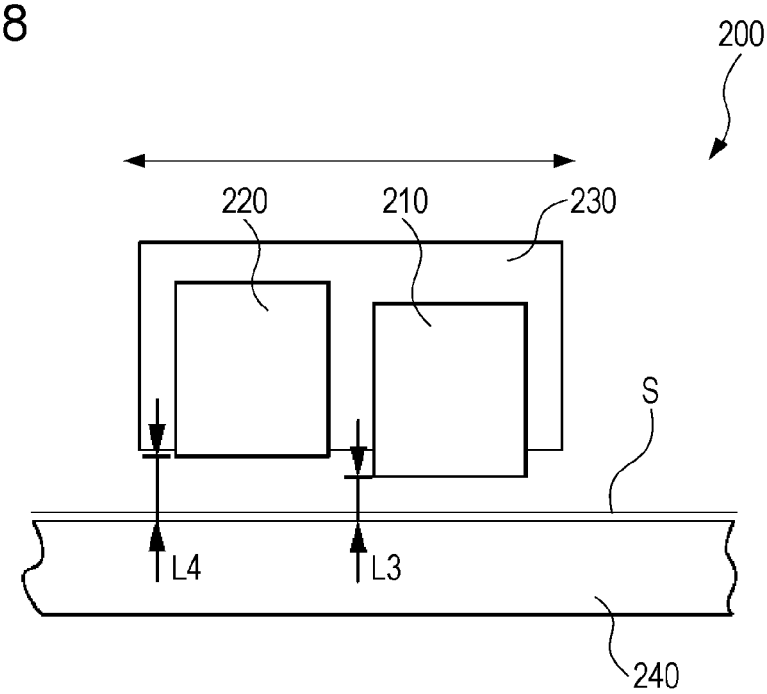
FIG. 18 is a view showing the distance between a second head and a platen, which is set to be larger than the distance between a first head and the platen.

FIG. 18 is a view showing the periphery of a first head 210 and a second head 220 of a printer 200 according to the modified example. The printer 200 is the above-described serial printer. As shown in FIG. 18, the first head 210 and the second head 220 are provided in a carriage 230. A distance L4 between the second head 220 and a platen 240 is set to be larger than a distance L3 between the first head 210 and the platen 240.

The carriage 230 is reciprocally moved in a horizontal direction of the drawing, as denoted by an arrow of the drawing. The paper S is transported from a rear side to a front side of the drawing along the platen 240 as a support member of the paper S. In the printer 200, the transportation of the paper S and the reciprocal movement of the carriage 230 are repeated. Nozzles are arranged in the surfaces of the first and the second heads 210 and 220, which face the paper S, in a direction crossing the movement direction of the carriage 230.

Whenever the transportation of the paper S is stopped, the carriage 230 is moved from the left side to the right side of the drawing. During the movement, the first head 210 discharges the chromatic ink (liquid) and the second head 220 discharges the achromic ink. In addition, when the carriage 230 is moved from the right side to the left side of the drawing, the ink is not discharged from both the first head 210 and the second head 220. This is because, in the carriage 230, the first head 210 is positioned at the downstream side in the movement direction of the carriage 230 and the second head 220 is positioned at the upstream side in the movement direction of the carriage 230. That is, this is because, thereafter, a portion of the paper S, in which the ink is discharged from the first head 210, faces the second head 220. Accordingly, in the printer 200, the so-called unidirectional printing for discharging the ink when the carriage 230 moves forward or backward is performed.

Accordingly, in the printer 200, the movement of the paper S and the reciprocal movement of the carriage 230 are repeated. The chromatic liquid is discharged from the first head 210 so as to a print image on the paper S and the achromic liquid is discharged from the second head 220 in the periphery of the formed print image. For example, as described in the first embodiment, the print image represented by the reference numeral A of FIG. 10C is formed and the achromic ink is discharged in the range represented by the reference numeral B.

In addition, even in the modified example, in the range in which the achromic liquid is discharged, represented by the reference numeral B, the achromic ink is discharged so as to form a gradation in which the dot density of the achromic ink is decreased from an inner periphery to an outer periphery. By this configuration, since a portion in which the amount of moisture permeated into the paper S is rapidly changed does not occur, it is possible to suppress the deformation of the cross-sectional shape due to a curved portion or a crinkled portion of the paper S.

As described above, the distance L4 between the second head 220 and the platen 240 is set to be larger than the distance L3 between the first head 210 and the platen 240. Accordingly, even when the paper S is curved or crinkled such that the cross-sectional shape is deformed, it is possible to suppress the curved portion of the paper S from being brought into contact with the second head 220.

In a case where the carriage 230 is moved from a position exceeding the paper width of the left side of the drawing to the right side of the drawing, even when the chromatic liquid is discharged from the first head 210 such that the front end of the paper S is bent at the left side of the drawing, it is possible to suppress the front end of the paper S from being brought into contact with the side surface of the second head 220.

Comparison Between Line Head Printer and Serial Printer

The invention is applicable to the serial printer. However, the invention has more excellent effect in the line head printer. Now, this will be described.

In the line head printer, the number of times of the transportation of the paper S necessary for performing the printing on the basis of overall print data is one. In other words, the printing of the paper S can be performed by one pass. Since the printing is performed in a short time, a time necessary for adsorbing or drying the ink hit on the paper S is susceptible to be insufficient. As a result, the paper S is susceptible to be deformed due to the excessive amount of moisture included in the fiber layer. In contrast, in the serial printer, since the carriage is moved in the paper width direction several times so as to intermittently record pixels, the ink is adsorbed or dried during the recording. As a result, the paper S is hard to be deformed compared with the line head printer. Since the invention is made with a view to the deformation of the paper S, the more excellent effect can be obtained in the line head printer, rather than the serial printer.

In addition, as described above, when the invention is applied to the serial printer, the invention is restrictively applied to the unidirectional printing. As a result, it is difficult to increase a print speed. Accordingly, it is preferable that the invention is applied to the line head printer.

Combination of Embodiments

In the above-described embodiments, any one embodiment and another embodiment may be combined.

For example, like the first embodiment, in the printer including the first head unit 30 in which the first short heads 31(1) to 31(4) are arranged in the zigzag manner and the second head unit 40 in which the second short heads 41(1) to 41(4) are arranged in the zigzag manner, like the second embodiment, the chromatic inks (for example, the black ink, the cyan ink, the magenta ink and the yellow ink) of the same types as the chromatic inks discharged from the first head unit 30 may be discharged from the second head unit 40.

Like the fifth embodiment, in the printer including the first head unit 30C in which the plurality of first heads 31'(1) to 31'(4) are linearly arranged and the second head unit 40C in which the plurality of second heads 41'(1) to 41'(4) are linearly arranged, like the second embodiment, the second head unit 40C may be mounted at a position shifted from the first head unit 30C by a half (D/2) the dot pitch D in the paper width direction. By this configuration, the print resolution becomes twice the nozzle pitch and an image with high resolution can be printed at a high speed.

Other Modified Examples

In the first embodiment, the CPU 12 of the printer 1 reads and executes the program stored in the memory 13 such that the image data including the color information of red, blue and green is converted into the print data including the color information of yellow, magenta and cyan or the discharge data for discharging the achromic ink in the peripheral range of the print image is prepared. The image data including the color information of red, blue and green may be converted into the print data including the color information of yellow, magenta and cyan or the discharge data for discharging the achromic ink in the peripheral range of the print image may be prepared, by a printer driver installed in the memory of the computer 100. The above-described technology is applicable to a case of generating bubbles in the nozzles using a heater and discharging the liquid by the bubbles.

The above-described technology is applicable to various industrial apparatuses, in addition to the printer for discharging the ink onto the paper and performing the printing. For example, there are a cloth printing apparatus for printing a pattern on a cloth and an apparatus for manufacturing a display such as an organic light-emitting diode.

What is claimed is:

1. A liquid discharging device comprising:

a first head unit which discharges liquid;

a second head unit which faces a portion of a medium, in which the liquid is discharged from the first head unit, and discharges liquid; and a support member which faces the first head unit and the second head unit and supports the medium, wherein in the first head unit and the second head unit, a plurality of nozzles are arranged in a crossing direction crossing a transporting direction of the medium over an overall dischargeable range of the liquid, and a distance between the second head unit and the support member is larger than that between the first head unit and the support member, wherein the first head unit includes a first nozzle row group in which first nozzle rows having a length shorter than the dischargeable range are arranged in a zigzag manner such that the nozzles are arranged over the overall dischargeable range, and the second head unit includes a second nozzle row group in which second nozzle rows having a length shorter than the dischargeable range are arranged in the zigzag manner such that the nozzles are arranged over the overall dischargeable range.

2. The liquid discharging device according to claim 1, wherein:

the first head unit discharges chromatic liquid, and the second head unit discharges achromic liquid.

3. The liquid discharging device according to claim 2, wherein:

one of the first head unit and the second head unit discharges the achromic liquid in the periphery of a range in which the chromatic liquid is discharged from the other of the first head unit and the second head unit, and a dot density of the achromic liquid discharged from one of the first head unit and the second head unit is lower than that of the chromatic liquid from the other of the first head unit and the second head unit.

4. The liquid discharging device according to claim 1, wherein:

the first head unit discharges achromic liquid, and the second head unit discharges chromatic liquid.

5. The liquid discharging device according to claim 1, wherein the first head unit and the second head unit discharge chromatic liquid.

6. The liquid discharging device according to claim 5, wherein the second head unit discharges the liquid having a color different from that of the liquid discharged from the first head unit.

7. The liquid discharging device according to claim 5, wherein the second head unit includes a plurality of second nozzles of which positions in an orthogonal direction orthogonal to the transporting direction of the medium are aligned with the positions of a plurality of nozzles of the first head unit, the plurality of second nozzles discharging the liquid having the same color as the liquid discharged from the first head unit, and discharges the liquid in a portion of the medium, in which the liquid is not discharged from the first head unit.

8. The liquid discharging device according to claim 1, wherein a partition is mounted between the first head unit and the second head unit.

9. The liquid discharging device according to claim 1, further comprising an adjustment mechanism which adjusts any one of the distance between the first head unit and the support member and the distance between the second head unit and the support member.

10. The liquid discharging device according to claim 9, wherein the adjustment mechanism adjusts the distance between the second head unit and the support member.

11. A liquid discharging device comprising:

a first head unit which discharges liquid;

a second head unit which faces a portion of a medium, in which the liquid is discharged from the first head unit, and discharges liquid; and a support member which faces the first head unit and the second head unit and supports the medium, wherein in the first head unit and the second head unit, a plurality of nozzles are arranged in a crossing direction crossing a transporting direction of the medium over an overall dischargeable range of the liquid, and a distance between the second head unit and the support member is larger than that between the first head unit and the support member, wherein the first head unit includes a first nozzle row in which the plurality of nozzles are arranged in the crossing direction such that the nozzles are arranged over the overall dischargeable range, and the second head unit includes a second nozzle row in which the plurality of nozzles are arranged in the crossing direction such that the nozzles are arranged over the overall dischargeable range.

12. The liquid discharging device according to claim 11, wherein:

the first head unit discharges chromatic liquid, and the second head unit discharges achromic liquid.

13. The liquid discharging device according to claim 12, wherein:

one of the first head unit and the second head unit discharges the achromic liquid in the periphery of a range in which the chromatic liquid is discharged from the other of the first head unit and the second head unit, and a dot density of the achromic liquid discharged from one of the first head unit and the second head unit is lower than that of the chromatic liquid from the other of the first head unit and the second head unit.

14. The liquid discharging device according to claim 11, wherein:

the first head unit discharges achromic liquid, and the second head unit discharges chromatic liquid.

15. The liquid discharging device according to claim 11, wherein the first head unit and the second head unit discharge chromatic liquid.

16. The liquid discharging device according to claim 11, wherein the second head unit includes a plurality of second nozzles of which positions in an orthogonal direction orthogonal to the transporting direction of the medium are aligned with the positions of a plurality of nozzles of the first head unit, the plurality of second nozzles discharging the liquid having the same color as the liquid discharged from the first head unit, and discharges the liquid in a portion of the medium, in which the liquid is not discharged from the first head unit.

17. The liquid discharging device according to claim 11, wherein a partition is mounted between the first head unit and the second head unit.

18. The liquid discharging device according to claim 11, further comprising an adjustment mechanism which adjusts any one of the distance between the first head unit and the support member and the distance between the second head unit and the support member.

19. A liquid discharging device comprising:

a first head unit which discharges liquid;

a second head unit which faces a portion of a medium, in which the liquid is discharged from the first head unit, and discharges liquid; and a support member which faces the first head unit and the second head unit and supports the medium, wherein in the first head unit and the second head unit, a plurality of nozzles are arranged in a crossing direction crossing a transporting direction of the medium over an overall dischargeable range of the liquid, and a distance between the second head unit and the support member is larger than that between the first head unit and the support member, wherein the first head unit and the second head unit discharge chromatic liquid, and wherein the second head unit includes a plurality of second nozzles of which positions in an orthogonal direction orthogonal to the transporting direction of the medium are aligned with the positions of a plurality of nozzles of the first head unit, the plurality of second nozzles discharging the liquid having the same color as the liquid discharged from the first head unit, and discharges the liquid in a portion of the medium, in which the liquid is not discharged from the first head unit.

* * * * *